United States Patent [19]

Dobson et al.

[11] 3,974,984

[45] Aug. 17, 1976

[54] CONTROL OF GUIDED MISSILES

[75] Inventors: Geoffrey Townsend Dobson; Sidney George Chamberlain, both of Heston, England

[73] Assignee: British Aircraft Corporation, London, England

[22] Filed: Mar. 23, 1962

[21] Appl. No.: 183,007

[30] Foreign Application Priority Data

Mar. 24, 1961 United Kingdom ..... 10943/61

[52] U.S. Cl. ..... 244/3.11; 89/1.8

[51] Int. Cl.[2] ..... F41G 7/00; F41G 7/14

[58] Field of Search ..... 102/50; 89/41.6, 41.62, 89/41.70, 1.7, 1.8; 244/14, 3.11; 33/49

[56] References Cited

UNITED STATES PATENTS

| | | | |
|---|---|---|---|
| 1,249,274 | 12/1917 | Chandler | 102/3 |
| 1,322,153 | 11/1919 | Wilson et al. | 89/41.6 |
| 2,836,894 | 6/1958 | Wagner | 89/41.6 |
| 2,971,437 | 2/1961 | Suiters | 244/14 |
| 3,043,197 | 7/1962 | Piper et al. | 244/14 |
| 3,069,975 | 12/1962 | Nauschutz et al. | 102/49 |

*Primary Examiner*—Samuel W. Engle
*Assistant Examiner*—Thomas H. Webb
*Attorney, Agent, or Firm*—Cushman, Darby & Cushman

EXEMPLARY CLAIM

1. A visual aimer for use in the control of a guided missile comprising in combination, computer means for generating course correcting signals for the missile before and during flight, means transmitting the correcting signals to the missile, a first manual control coupled to said means to effect a first mode of course correction in the missile, a rotatable optical sight having a hand grip for rotating the sight about a vertical axis in aiming the sight at a target, an angular datum pivot member for said sight positioned along said vertical axis and including means to hold the pivot member stationary against rotation with said sight, a rotary potentiometer having relatively movable parts respectively coupled to the datum member and rotatable sight, connections to the computer from the potentiometer to signal the relative angular displacement of the datum member and the sight to said computer means, and means in the computer to effect a further mode of course correction in the missile before launching to cause it to follow an initial launching course designated by the corresponding positions of said relatively movable parts and a further adjustable manual electrical control connected to the computer and means responsive to the adjustment of the latter to generate a compensating signal operatively connected to compensate for the lateral displacement of the sight from the actual line of flight of the missile.

1 Claim, 6 Drawing Figures

Figure 1:
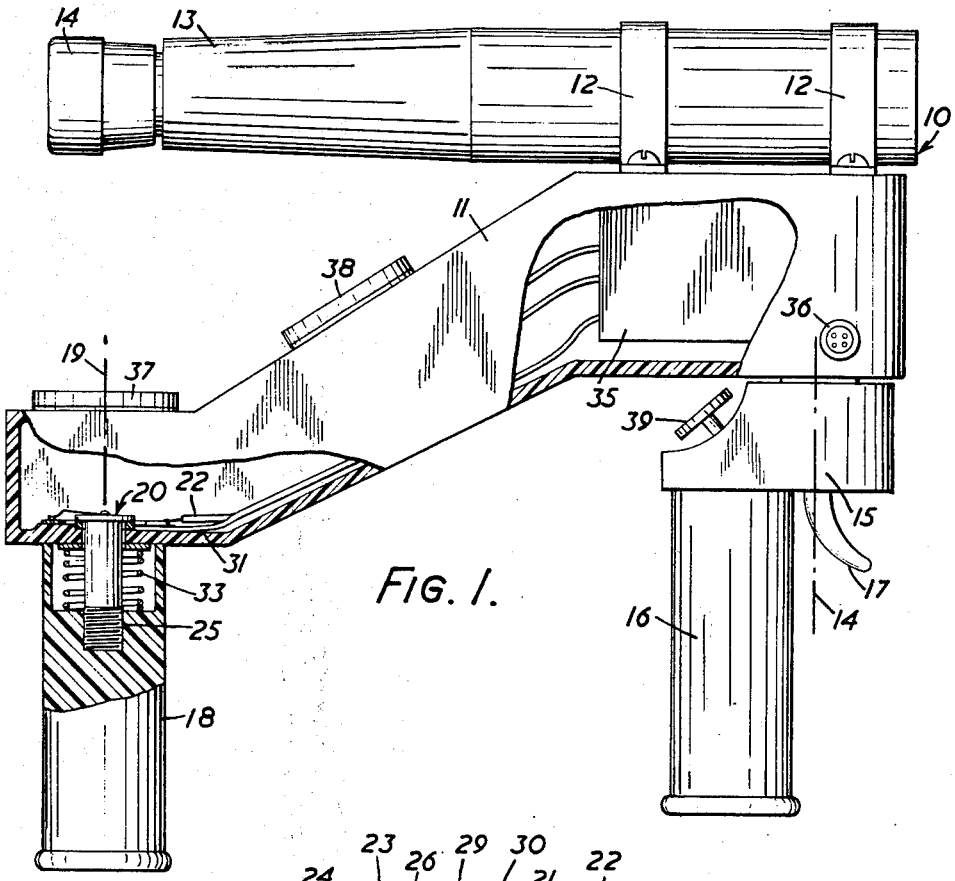

INVENTORS
GEOFFREY T. DOBSON
SIDNEY G. CHAMBERLAIN.

BY
Watson, Cole, Grindle & Watson

INVENTORS
GEOFFREY T. DOBSON
SIDNEY G. CHAMBERLAIN.

BY
Watson, Cole, Grindle & Watson

INVENTORS
GEOFFREY T. DOBSON
SIDNEY G CHAMBERLAIN.

BY
Watson, Cole, Grindle & Watson
ATTORNEY

CONTROL OF GUIDED MISSILES

This invention relates to the control of guided missiles of the ground-to-ground type by means of a ground control unit comprising a visual aimer and means for transmitting course-correcting signals to the missile while in flight to bring it on to a target viewed through the aimer. The invention is particularly although not exclusively applicable to missiles of the type controlled by electric signals transmitted from the ground control station through electrically-conducting wire trailing from the missile while in flight.

A difficulty with such systems is that if a target appears at a considerable angle to one side or the other of the initial launching course to which the missile is set, then either valuable time must be wasted in resetting the missile before firing to alter its launching course towards the target, or the missile must be launched on an initial course deviating substantially from the direction in which the target lies, when the controller may have considerable difficulty in bringing the missile on to the target course indicated by the aimer during the available time of flight.

According to the present invention the aimer, which is provided with a manual control for initiating or controlling the transmission of course-correcting signals to the missile, comprises a body carrying an optical sight for aiming at a target in front of the aimer, the aimer body being adapted to be turned by an operator about a vertical axis of rotation passing close to the eyepiece of the sight in aiming the sight at the target, and the aimer also includes an angular datum member pivoted to the aimer body about the said vertical axis and adapted to be held stationary against rotation when the aimer body is turned about the said axis in aiming at a target, and electrical means responsive to the relative angular displacement of the datum member to the line of sight of the aimer body for automatically pre-conditioning the missile before launching to cause it to follow an initial launching course corresponding to the said relative angular disposition.

The datum member may comprise a leg or tripod or other support pivoted to the aimer body and adapted to stand or rest on the ground or in some other solid support while the aimer is aimed manually.

However in one convenient arrangement the datum member comprises a rear hand grip adapted to be held by the operator in one hand, and the aimer is also provided with a front hand grip adapted to be gripped by the operator's other hand so that he supports the whole aimer manually while aiming by turning it about the said vertical axis by means of the front hand grip and holds the rear hand grip stationary against rotation.

Figure 3:
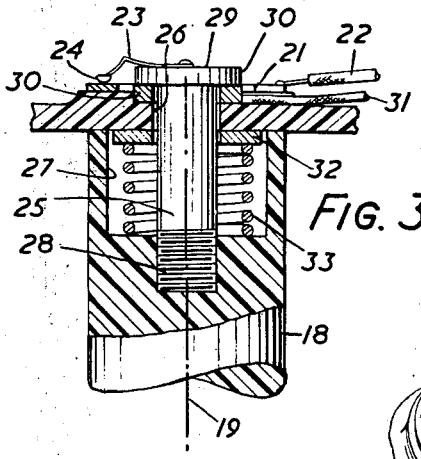
Figure 2:
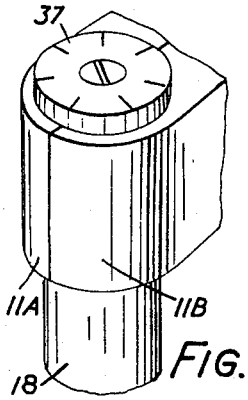
Figure 4:
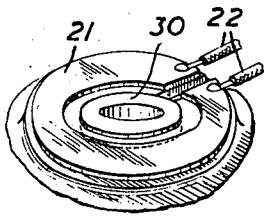
Figure 5:
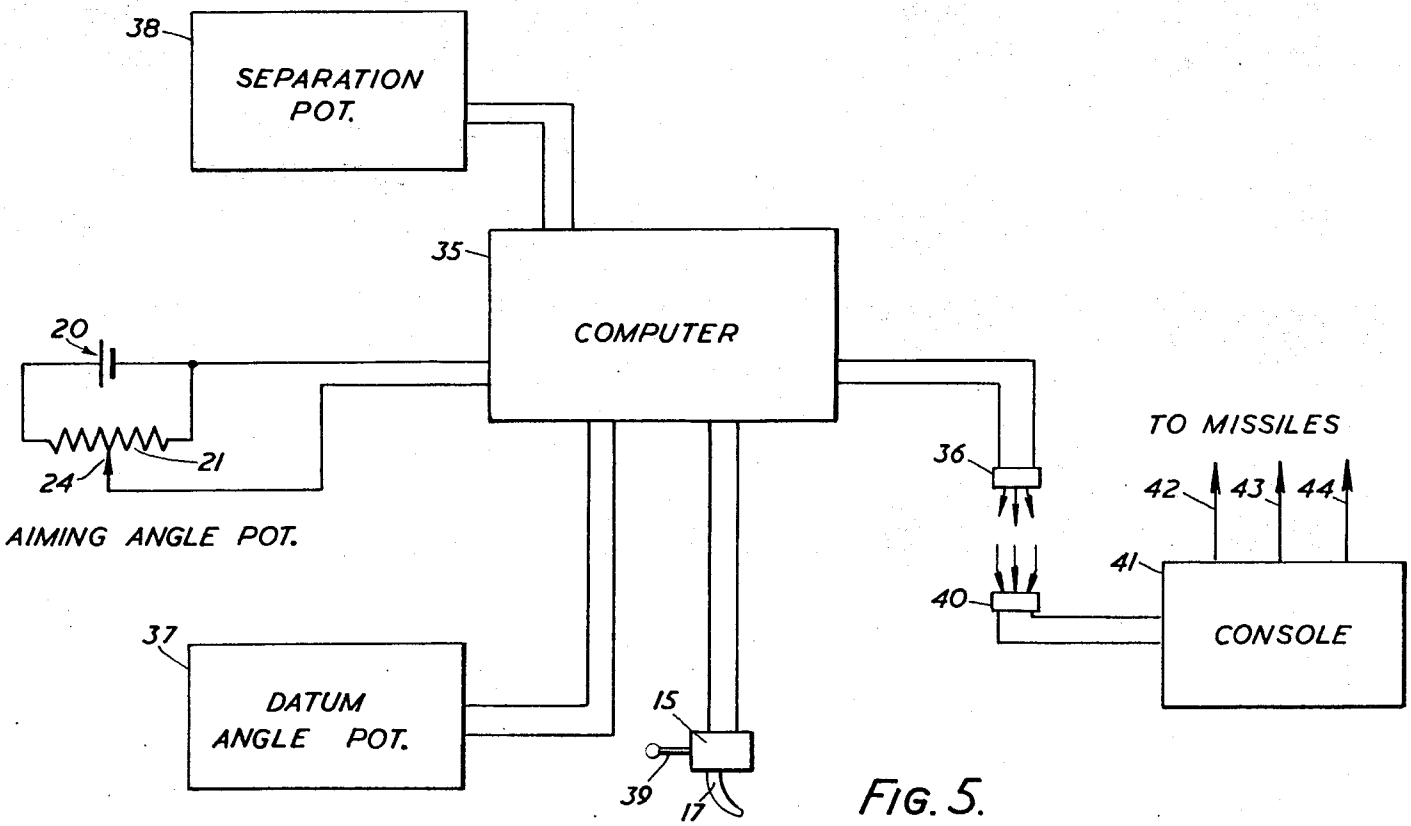
Figure 6:
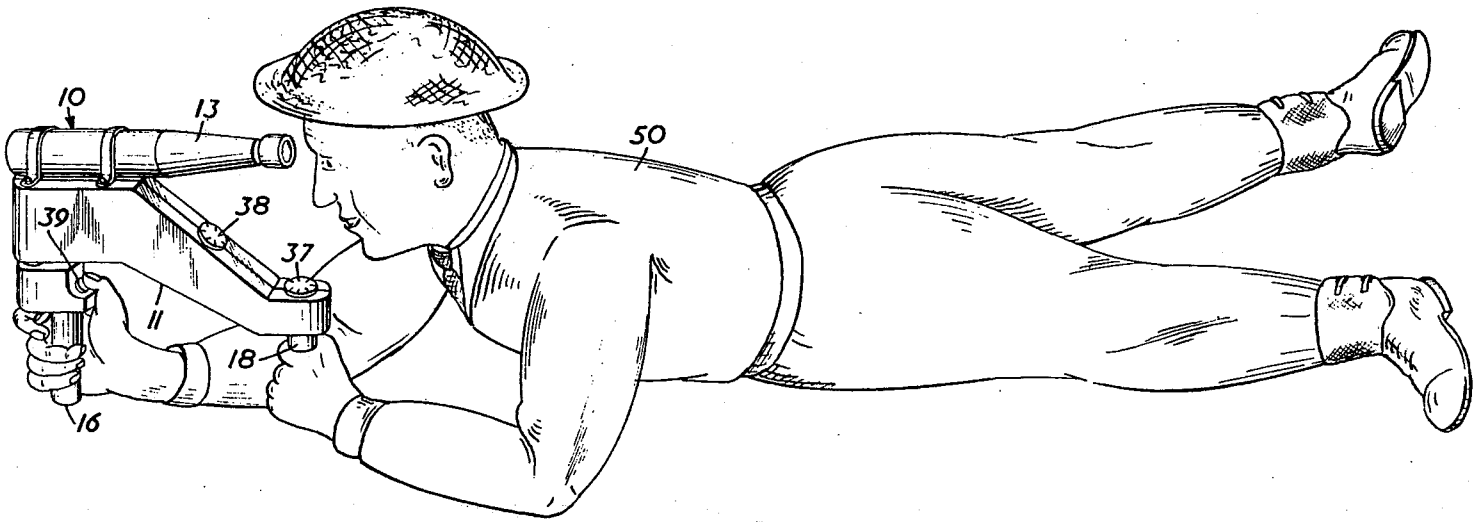

The invention may be carried into practice in various ways but one specific embodiment will now be described by way of example only, with reference to the accompanying drawings, in which:

FIG. 1 is a side elevation, partly in section, of an aimer for use in controlling a guided missile of the ground-to-ground type, FIG. 2 is a fragmentary perspective view showing from above the rear upper part of the aimer body, FIG. 3 is a fragmentary sectional view of part of the rear hand grip of the aimer showing the associated potentiometer, FIG. 4 is a fragmentary perspective view of the top of the potentiometer of FIG. 3, FIG. 5 is a block diagram illustrating the interrelationship of the various parts of the aimer with one another and with an associated control console, and FIG. 6 is a view showing how the aimer is operated in service.

In the illustrated embodiment, there is shown in FIG. 1 an aimer 10 for use in conjunction with a control console arranged to transmit course-correcting signals to a guided missile while in flight to bring it on to the target viewed through the aimer. The aimer comprises a cranked hollow body 11 made in two parts from two similar shells 11A and 11B of moulded thermosetting synthetic resin, which are bolted together along the longitudinal plane of section of the body 11. Mounted rigidly on top of the body 11 by means of straps 12 is a telescopic sight 13 provided with an adjustable eyepiece 14 and containing suitable internal cross wires which can be employed in conjunction with the optical system of the telescopic sight for aiming accurately at a target.

Pivoted beneath the front of the body 11 of the aimer 10 about a vertical pivotal axis 14 is a bracket 15, to the underside of which is secured a front hand grip 16. The aimer body 11 can thus be rotated relative to the front hand grip 16 about the pivotal axis 14. The pivotal movement of the front hand grip 16 serves only to provide a firm but comfortable grip for the operator's hand, which thus does not have to rotate with the body 11. A firing trigger 17 for firing a missile is mounted in the bracket 15 and extends below it in front of the front hand grip 16.

A rear hand grip 18, generally similar to the front hand grip 16, is pivotally mounted beneath the rear end of the aimer body 11 for pivotal movement about a vertical axis 19 relative to the body. A potentiometer 20 is mounted within the body 11 of the aimer at its rear end, at the top of the rear hand grip 18, the potentiometer 20 comprising an annular resistive track 21, for example made of carbon film adhering to an insulating support mounted on the bottom wall of the body 11. The resistive track 21 is gapped in the radial direction, and its two ends are connected to electrically conducting leads 22. A rotary pick-off arm 23 carrying a contact 24 at its outer end extends radially from the head of a brass bolt 25, coaxial with the track 21, which passes through an aperture 26 in the bottom wall of the body into a well 27 formed in the top end of the rear hand grip 18, the lower end of the bolt 25 being screwed into a tapped hole 28 formed in the hand grip 18 so that the bolt 25 is rigidly mounted coaxially on the hand grip 18. Thus rotation of the hand grip 18 relative to the body 11 causes the pick-off arm 23 to rotate relative to the annular track 21.

The moving contact 24 of the pick-off arm 23 is arranged to be in sliding contact with the resistive track 21, so that rotation of the body 11 of the aimer relatively to the rear hand grip 18 about the axis 19 causes the moving contact 24 to slide around the track 21 and to vary the lengths of the arcs of the conducting track 21 between the point of engagement of the contact 24 and the two ends of the track 21, in accordance with the angle through which the body 11 has rotated relative to the hand grip 18. The pick-up arm is electrically connected to the head 29 of the bolt 25, which rests on a metal ring 30 laid into an annular recess around the top of the aperture 26 in the bottom wall of the body 11. An electric lead 31 connected at its end to the ring 30 is lead through the wall of the body 11, being enclosed in a recess between the abutting edges of the two shells 11A and 11B where it passes beneath the track 21 and emerging outside the track into the interior of the body 11. Thus the sliding contact 24 of the rotary pick-up arm is electrically connected via the bolt head 29 and ring 30 to the lead 31. A degree of frictional damping is imposed between the hand grip 18 and the body 11 by means of a friction washer 32, which surrounds the bolt 25 and is pressed against the under surface of the bottom wall of the body 11 by means of a compression spring 23 surrounding the shank of the bolt 25 in the well 27, the spring 33 acting between the washer 32 and the bottom of the well 27.

Mounted within the interior of the hollow body 11 at its front end is a computer indicated at 35, the outputs of the computer being electrically connected to an outlet socket 36 in the side of the body 11 for connection to an associated electronic control console.

The electric leads 22 and 31 which extend from the potentiometer 20 are connected to one input connection of the computer 35, which is provided with various other input connections to which are connected other components incorporated in the aimer. Thus a datum-angle-setting potentiometer 37 is mounted in the body 11 at its rear end above the potentiometer 20. A further potentiometer 38, referred to as the separation potentiometer and intended to be set in accordance with the linear separation in yards between the associated control console and a missile launching station located to one side of the console, is mounted in the cranked portion of the aimer body 11. A manual control knob 39 is mounted in the bracket 15 in a position in which it can be manually actuated by the user's thumb, in the manner of an aircraft control column, and is used to control the transmission of course-correcting signals to the missile when in flight. The potentiometers 37 and 38, and the course-correcting control 39 and the firing trigger 17 are all connected to the computer 35, as indicated diagrammatically in FIG. 5. The output of the computer 35 is taken from the socket 36, into which can be inserted a co-operating plug connector 40 which is connected to the ends of leads from the associated control console 41. The control console 41 is connected by leads 42, 43, 44, etc., to the various launching stations for controlling the missiles prior to and during launching and in flight.

Thus in use, the aimer 10 is held as shown in FIG. 6 by an individual operator 50 who may for example be lying on the ground, the operator gripping the rear hand grip 18 in his left hand, and gripping the front hand grip 16 in his right hand with his thumb on the control 39 and his trigger finger on the firing trigger 17. The operator 50 thus supports the aimer in an upright position in his two hands, keeping his left hand firmly in a fixed position on the ground so as to prevent rotation or translatory movement of the rear hand grip 18. The operator 50 can then rotate the body 11 of the aimer 10 about the pivotal axis 19 of the rear hand grip by means of his right hand which grips the front hand grip 16, and can thus aim the aimer 10 accurately at any frontal target by means of the telescope sight 13.

Thus in use, before a target is expected to appear, the operator sets up the aimer pointing generally in the direction of a datum line of sight, constituted by the direction in which he is facing as he lies on the ground. Wherever possible the stability of the datum line-of-sight will be improved by the operator obtaining extra support for his body, or at least for his left forearm or hand which anchors the rear hand grip, or for the rear hand grip itself, on any solid support available, e.g. the ground or some solid object.

The operator now pre-sets the datum-angle-setting potentiometer 37 to a setting corresponding to the angle between the initial launching direction of the missile on its launching site and the datum line-of-sight direction referred to above at which he initially aims the aimer 10. He also pre-sets the separation potentiometer 38 in accordance with the lateral displacement of the missile launching station from the aimer.

If now a target suddenly appears at a substantial angle to left or right of the datum line-of-sight referred to, the operator without turning his body or moving his left hand which holds the rear hand grip 18, turns the aimer in the corresponding direction about the pivotal axis 19 by means of the front hand grip 16 until he sights the target through the telescopic sight 13 of the aimer. The rear hand grip 18 which is firmly held by the operator's left hand does not rotate with the aimer body 11 about the pivotal axis 19 and thus constitutes a fixed angular datum, so that the relative rotation of the aimer body 11 causes relative angular movement between the track 21 and pick-off contact 24 of the potentiometer 20, thereby altering the setting of this potentiometer and causing a corresponding signal to be transmitted from the computer 35 to the control console 41, to cause it to automatically re-set the missile on its launching sight for travel generally along the required course towards the target sighted through the aimer. This re-setting of the missile is effected either by bodily rotating the missile through a corresponding angle on a rotating support on its launching site, to alter its initial orientation prior to launching, or by adjusting the jet pipe or other course control device on the missile in an appropriate manner either prior to launching or immediately after launching, so as to ensure that the missile is immediately brought around onto the required course after launching so that for the remainder of its flight it will travel generally towards the target being aimed at by the operator. After this initial automatic course-setting of the missile, the operator will readily be able to apply such secondary course-correcting control as may be necessary during the flight of the missile towards the target, by appropriate manipulation of the course-setting control 39 by means of his right thumb. When the missile is of the trailing-wire type, these course-correcting signals are transmitted from the control console via the trailing leads to the flying missile.

The use of the aimer 10, by virtue of the variation in the setting of the potentiometer 20 resulting from the angular displacement of the body 11 of the aimer relatively to the fixed rear hand grip 18 consequent on aiming at a target offset from the datum line-of-sight, thus serves automatically to correct the course of the missile on launching so as to bring it generally on to the required line of flight towards the target being aimed at. The operator is relieved of the necessity of having to provide this initial course-setting by preliminary manual control, and the risk of the missile departing so far from the required course along its initial launching direction that the operator can no longer bring it back towards the target by his manual control in sufficient time before the target is overshot, is thus avoided. The operator only has the task of keeping the aimer aimed properly at the target and applying such secondary course-correcting control to the missile by means of the control means 39, after it has been automatically brought generally on to the course towards the target by the control console.

The preliminary adjustment of the potentiometer 37 serves to cause the computer 35 to feed into the control console 41 a presetting signal which will cause the console to apply an initial course-setting pre-adjustment to the missile such that on launching it would assume an initial course along the datum line-of-sight of the aimer. The alteration of the setting of the potentiometer 20 caused by aiming the aimer 10 at a target offset from the datum line-of-sight superimposes a further course-setting adjustment on the missile prior to launching. The setting of the separation potentiometer 38 provides a signal arranged to compensate for the lateral displacement of the aimer from the actual line of flight of the missile from its launching station.

What we claim as our invention and desire to secure by Letters Patent is:

1. A visual aimer for use in the control of a guided missile comprising in combination, computer means for generating course correcting signals for the missile before and during flight, means transmitting the correcting signals to the missile, a first manual control coupled to said means to effect a first mode of course correction in the missile, a rotatable optical sight having a hand grip for rotating the sight about a vertical axis in aiming the sight at a target, an angular datum pivot member for said sight positioned along said vertical axis and including means to hold the pivot member stationary against rotation with said sight, a rotary potentiometer having relatively movable parts respectively coupled to the datum member and rotatable sight, connections to the computer from the potentiometer to signal the relative angular displacement of the datum member and the sight to said computer means, and means in the computer to effect a further mode of course correction in the missile before launching to cause it to follow an initial launching course designated by the corresponding positions of said relatively movable parts and a further adjustable manual electrical control connected to the computer and means responsive to the adjustment of the latter to generate a compensating signal operatively connected to compensate for the lateral displacement of the sight from the actual line of flight of the missile.

* * * * *